US005913448A

United States Patent [19]

Mann et al.

[11] Patent Number: 5,913,448

[45] Date of Patent: Jun. 22, 1999

[54] COLLAPSIBLE CONTAINER

[75] Inventors: David G. Mann, Wooster; Steve Paletti, Columbus; Kevin Rausch, Wooster; Rainer B. Teufel, Columbus, all of Ohio

[73] Assignee: Rubbermaid Incorporated, Wooster, Ohio

[21] Appl. No.: 08/889,380

[22] Filed: Jul. 8, 1997

[51] Int. Cl.[6] ..... B65D 3/04

[52] U.S. Cl. ..... 220/666; 220/92

[58] Field of Search ..... 220/666, 9.2, 8

[56] References Cited

U.S. PATENT DOCUMENTS

| | | | |
|---|---|---|---|
| 1,583,083 | 5/1926 | Macaraig | 220/9.2 |
| 2,725,087 | 11/1955 | Potter | 220/666 X |
| 3,280,871 | 10/1966 | Taylor | 220/666 X |
| 3,347,060 | 10/1967 | Barkan | 220/666 X |
| 3,480,059 | 11/1969 | Schoening | 220/666 X |
| 4,157,103 | 6/1979 | LaFleur | 220/666 X |

*Primary Examiner*—Steven Pollard
*Attorney, Agent, or Firm*—Renner, Kenner, Greive, Bobak, Taylor & Weber

[57] ABSTRACT

A collapsible container (10) includes a first wall (12) and a second wall (14) connected by a collapsible and expandable third wall (16). The third wall (16) includes an interior wall (20) and an exterior wall (22) that are each collapsible and expandable. At least one spring (60) extends between the first wall (12) and the second wall (14) between the interior wall (20) and the exterior wall (22) to urge the first and second walls (12, 14) apart. Straps (62) also extend between the first wall (12) and the second wall (14) to counteract the force of the spring (60). The length of the straps (62) between the first wall (12) and the second wall (14) is adjustable between a fully collapsed and fully expanded position. The length of the straps (62) is adjustable because the straps (62) slidingly engage the second wall (14) and are held with respect to the second wall (14) by locking devices (64). The locking devices (64) normally engage the straps (62) to lock their position with respect to the second wall (14) but may be released to allow the second wall (14) to move away from the first wall (12). The locking devices (64) are also configured such that they do not need to be released for the second wall (14) to be moved toward the first wall (12).

20 Claims, 8 Drawing Sheets

COLLAPSIBLE CONTAINER

TECHNICAL FIELD

This invention relates to storage containers and, more particularly, to portable containers for temporarily storing cold items. Specifically, the present invention is related to a cooler having a collapsible and expandable side wall that allows the storage volume and overall size of the cooler to be varied.

BACKGROUND ART

Portable soft-sided and rigid-sided containers are available in numerous sizes for various uses. For instance, there are containers which are used as coolers that are specifically sized for an individual lunch, and coolers that are capable of holding food and beverages for a large family. A person thus typically owns many differently-sized coolers for different situations. Aside from the expense of purchasing multiple coolers, the coolers require substantial storage space while not in use. Although soft-sided coolers may be collapsed and stored in a relatively small space, soft-sided coolers are not generally available in large-family sizes because the soft, flexible walls cause such a cooler to be difficult to carry when fully loaded with beverages and ice. Large rigid-sided coolers are ideal in these situations because they do not sag or bend when fully loaded. Such coolers are, however, difficult to store because of their overall volume. It is thus desirable to provide a cooler that has the strength and rigidity of a rigid-sided cooler while being collapsible so that it is easy to store.

Rigid-sided coolers are typically fabricated from plastic or metals such that they are durable and prevent items inside the cooler from being damaged if another article impacts the cooler or if an article is placed on top of the cooler. One problem with a large, rigid-sided cooler is that the interior volume that must be cooled is constant. Thus, even if only a few small items are in the cooler, the coolant, which is typically ice, must maintain a relatively large volume of air cool to cool these items. Thus, it is desirable to provide a cooler that may be configured to adjust the interior volume that must be kept cool by the coolant.

DISCLOSURE OF THE INVENTION

It is thus an object of the present invention to provide a collapsible container that has a collapsible and expandable side wall that allows the interior volume and overall dimensions of the container to be adjusted.

It is another object of the present invention to provide a collapsible container, as above, that has a rigid base and a rigid upper wall such that the container protects items contained in the container.

It is yet another object of the present invention to provide a collapsible container, as above, that includes a collapsible and expandable side wall that may be locked at different positions between its fully collapsed and fully expanded positions.

It is still another object of the present invention to provide a collapsible container, as above, that automatically expands to its fully expanded position when a user depresses a pair of sliding locks.

It is a further object of the present invention to provide a collapsible container, as above, that may be stacked on top of a like container in either its fully expanded or fully collapsed position, or any position therebetween for storage.

These and other objects of the present invention, as well as the advantages thereof over existing prior art containers, which will become apparent from the description to follow, are accomplished by the improvements hereinafter described and claimed.

In general, a collapsible container includes a substantially rigid base, an upper wall opposing the base, and a collapsible and expandable wall extending between the base and the rigid wall.

A preferred exemplary collapsible container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
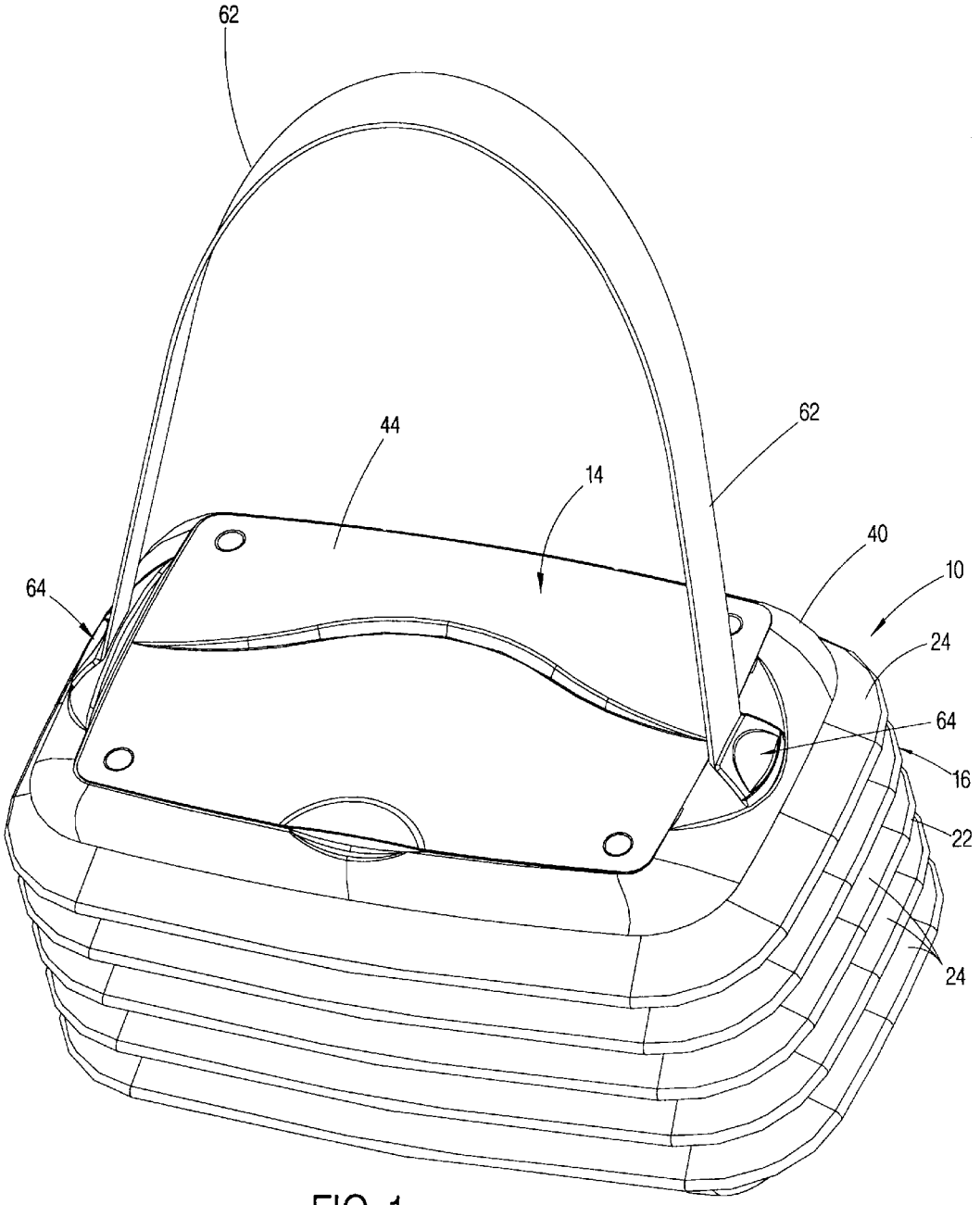
FIG. 1 is a perspective view of a collapsible container made in accordance with the concepts of the present invention showing the container in its fully expanded position.

A collapsible container made in accordance with the present invention is indicated generally by the numeral 10 in the accompanying drawings. Container 10 includes first and second opposed bottom and top walls, indicated generally by the numerals 12 and 14, respectively. A collapsible and expandable third wall, indicated generally by the numeral 16, extends between first wall 12 and second wall 14 to define the exterior dimensions of container 10. Container 10 is especially adapted to be used as a cooler and as such each of walls 12, 14 and 16 may preferably be fabricated from a material and in a manner that provides insulating properties to container 10. It is also preferred that walls 12, 14, and 16 be fabricated from a material and in a manner such that they are impervious to liquid so that the interior of container 10 is watertight. As such, the interior volume defined by walls 12, 14, and 16 may be used to hold cold items and a suitable coolant such as ice that functions to keep the items cool.

In the preferred embodiment of the present invention, third wall 16 includes a collapsible and expandable interior wall 20 spaced from a collapsible and expandable exterior wall 22 that each extend between and about peripheries of first wall 12 and second wall 14 to define the interior volume and exterior dimensions of container 10. Interior wall 20 and exterior wall 22 are spaced from each other in order to provide an insulating air barrier between the interior compartment of container 10 and the surrounding atmosphere.

Although numerous types of walls 20 and 22 may be utilized, exterior wall 22 in the preferred embodiment of the present invention is a bellows-type wall that may be collapsed and expanded by opening and closing a plurality of pleats 24. Pleats 24 may be configured and fabricated similarly to other pleats 24 known in the art. Pleats 24 having rigid or flexible sections will function with container 10.

Interior wall 20 of the preferred embodiment of the present invention is fabricated from a flexible, water-resistant material that has insulating properties. Interior wall 20 is collapsible and expandable due to its flexibility because it crumples when container 10 is collapsed and simply stretches back out when container 10 is expanded. It is also contemplated by the present invention that interior wall 20 may be formed as a pocket in container 10, and as such, that interior wall 20 can include a bottom wall 26.

Of course, the present invention contemplates the use of other collapsible and expandable wall configurations. For instance, third wall 16 may include a plurality of sections that are telescopingly received into one another. It is also understood that third wall 16 may be fabricated from just a single layer of flexible material such as discussed above with respect to interior wall 20. Third wall 16 may also be formed from a plurality of layers of flexible material that would crumple when container 10 was collapsed. Wall 16 may also include a combination of sections of flexible material and telescoping sections that have preset locking points. As can be seen, the collapsible and expandable wall of the present invention may take various forms and function in different ways.

First wall 12 may also be fabricated from various materials such as relatively rigid plastic or metal or a combination of flexible material over a rigid frame. In the preferred embodiment of the invention depicted in the drawings, first wall 12 is fabricated from rigid plastic and functions as the base of container 10. A plurality of feet 30 are attached to first wall 12 and extend downwardly therefrom to support container 10 when container 10 is placed on a substantially flat surface.

Figure 3:
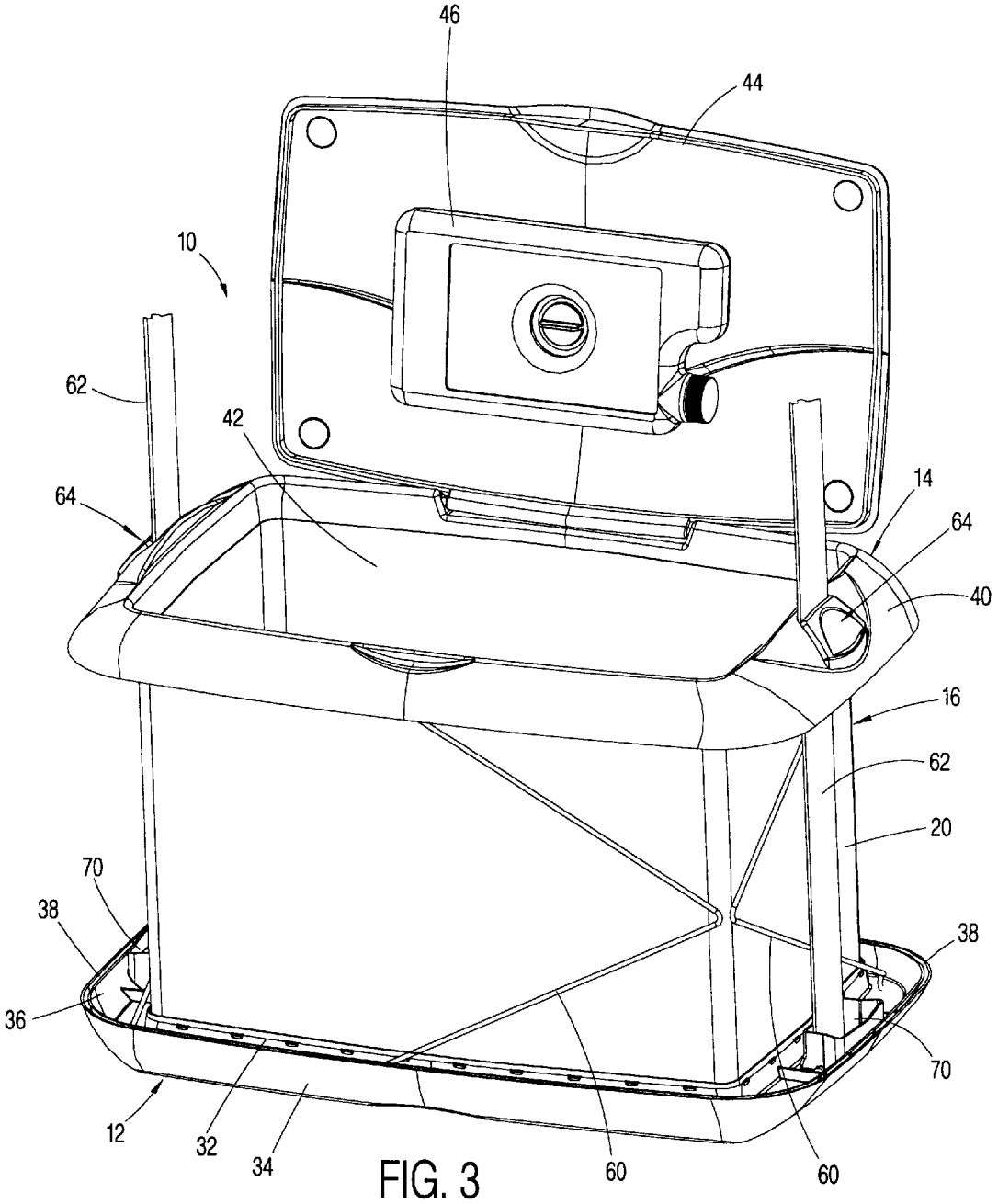
FIG. 3 is a perspective view of the collapsible container depicted in FIG. 1 with the exterior side wall removed.
Figure 4:
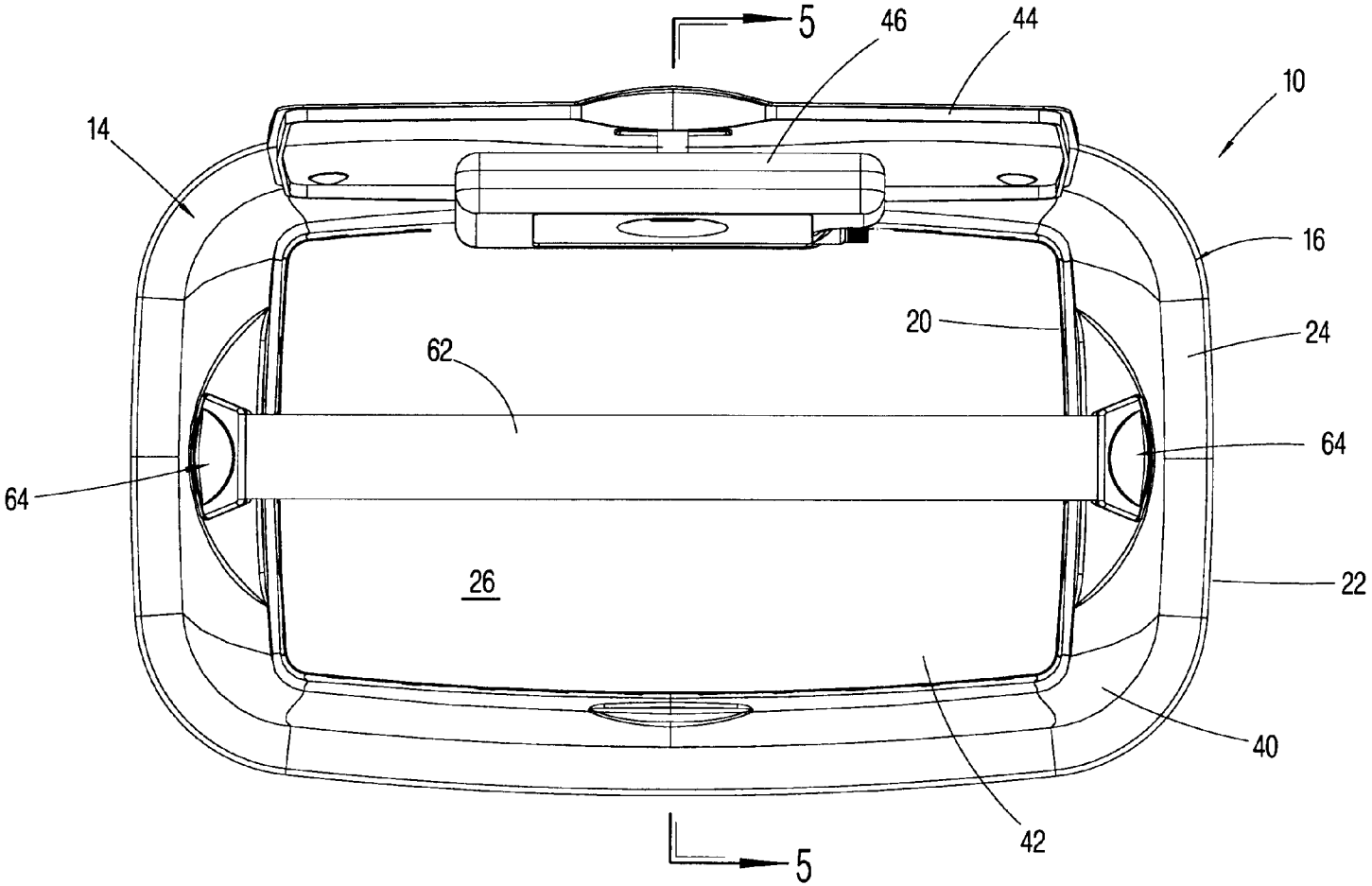
FIG. 4 is a plan view of the collapsible container depicted in FIG. 1 with the lid open.

Inner and outer circumferential lips, indicated by the numerals 32 and 34, respectively, extend upwardly from first wall 12 to define a channel 36 therebetween. Interior wall 20 is connected to inner lip 32 while exterior wall 22 is connected to outer lip 34 such that interior wall 20 is spaced from exterior wall 22. The connection between interior wall 20 and lip 32 provides a water-tight connection that allows container 10 to hold liquid such as water from melted ice. As may be perhaps best seen in FIG. 3, outer lip 34 may have a slot 38 in its upper surface to receive the lower portion of exterior wall 22 to attach exterior wall 22 to outer lip 34. Exterior wall 22 may be held in slot 38 by a plurality of teeth (not shown) that engage wall 22 when it is pushed into slot 38.

Second wall 14 may also be fabricated from various materials such as a relatively rigid plastic or metal or a combination of flexible material over a rigid frame. In the preferred embodiment of the invention depicted in the drawings, second wall 14 is fabricated from rigid plastic and functions as the lid of container 10. As such, second wall 14 has a circumferential rim 40 that has an opening 42 that provides access to the interior of container 10. A door 44 is pivotally attached to rim 40 between a closed position and an open position. A bottle 46 may be carried by door 44 such that bottle 46 is inside container 10 when door 44 is in the closed position depicted in FIGS. 1 and 2.

Figure 5:
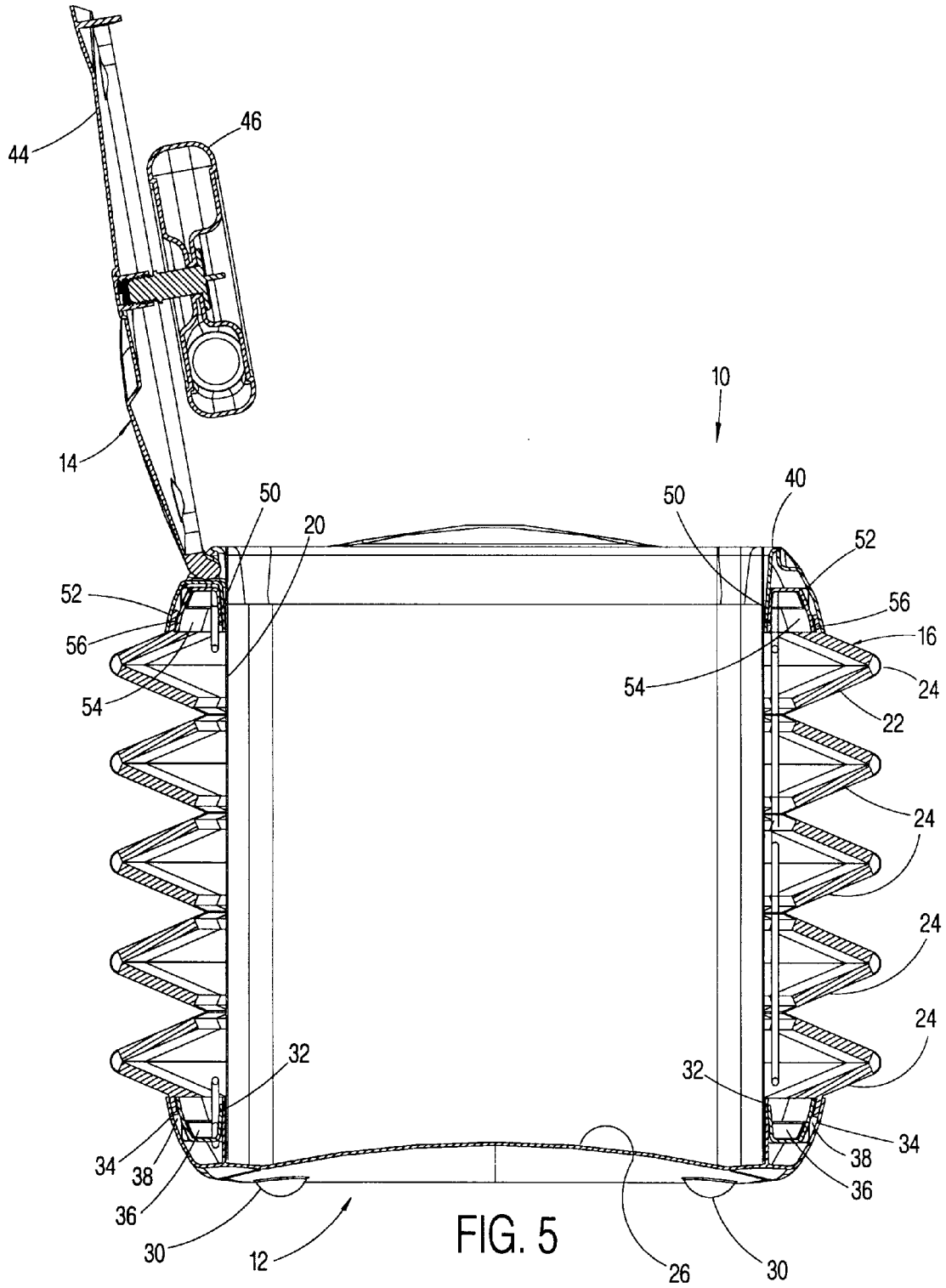
FIG. 5 is a sectional view of the collapsible container taken substantially along line 5—5 of FIG. 4.
Figure 6:
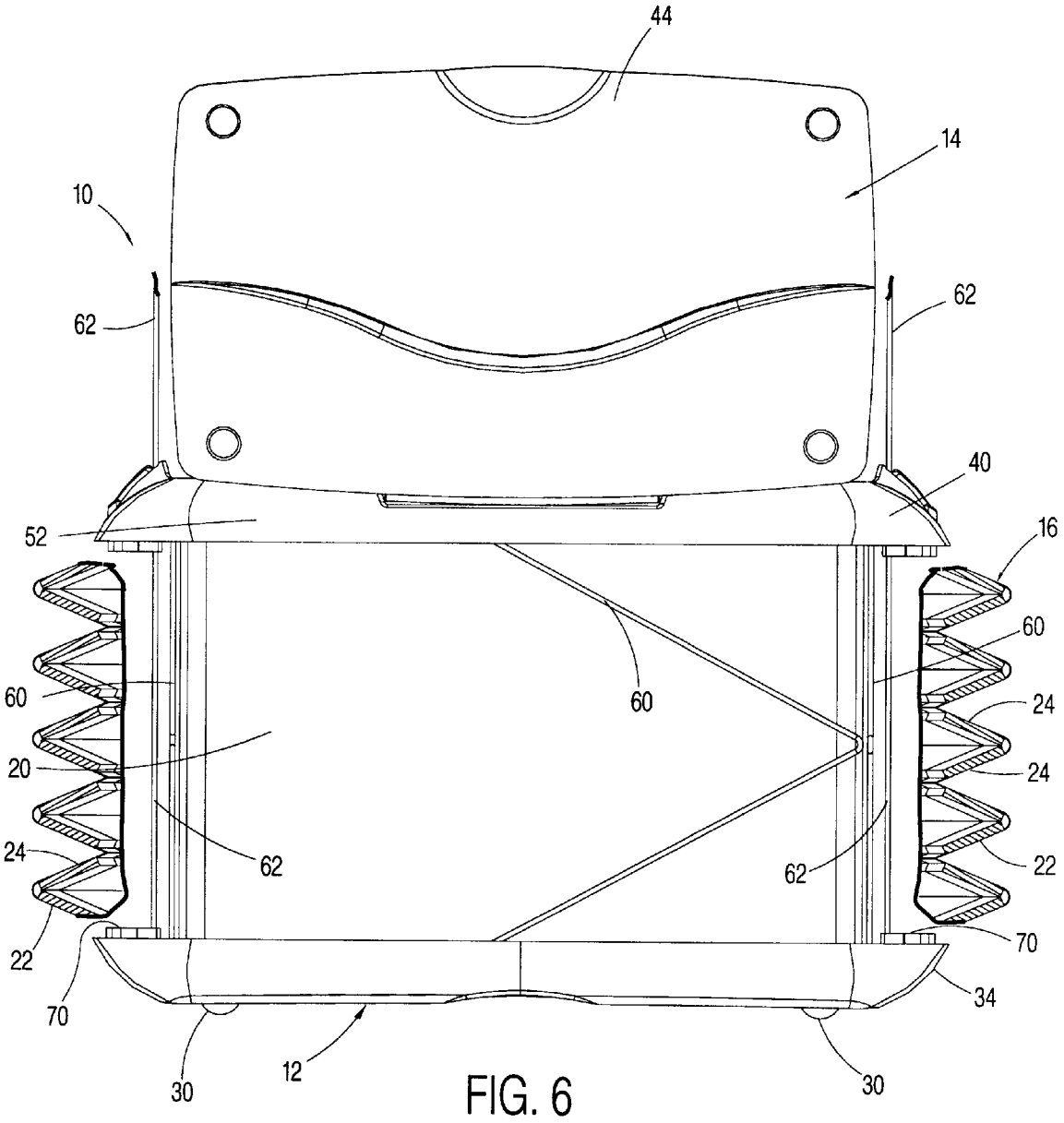
FIG. 6 is a rear elevational view of the container with part of the exterior side wall removed and part depicted in section and fragmented.
Figure 7:
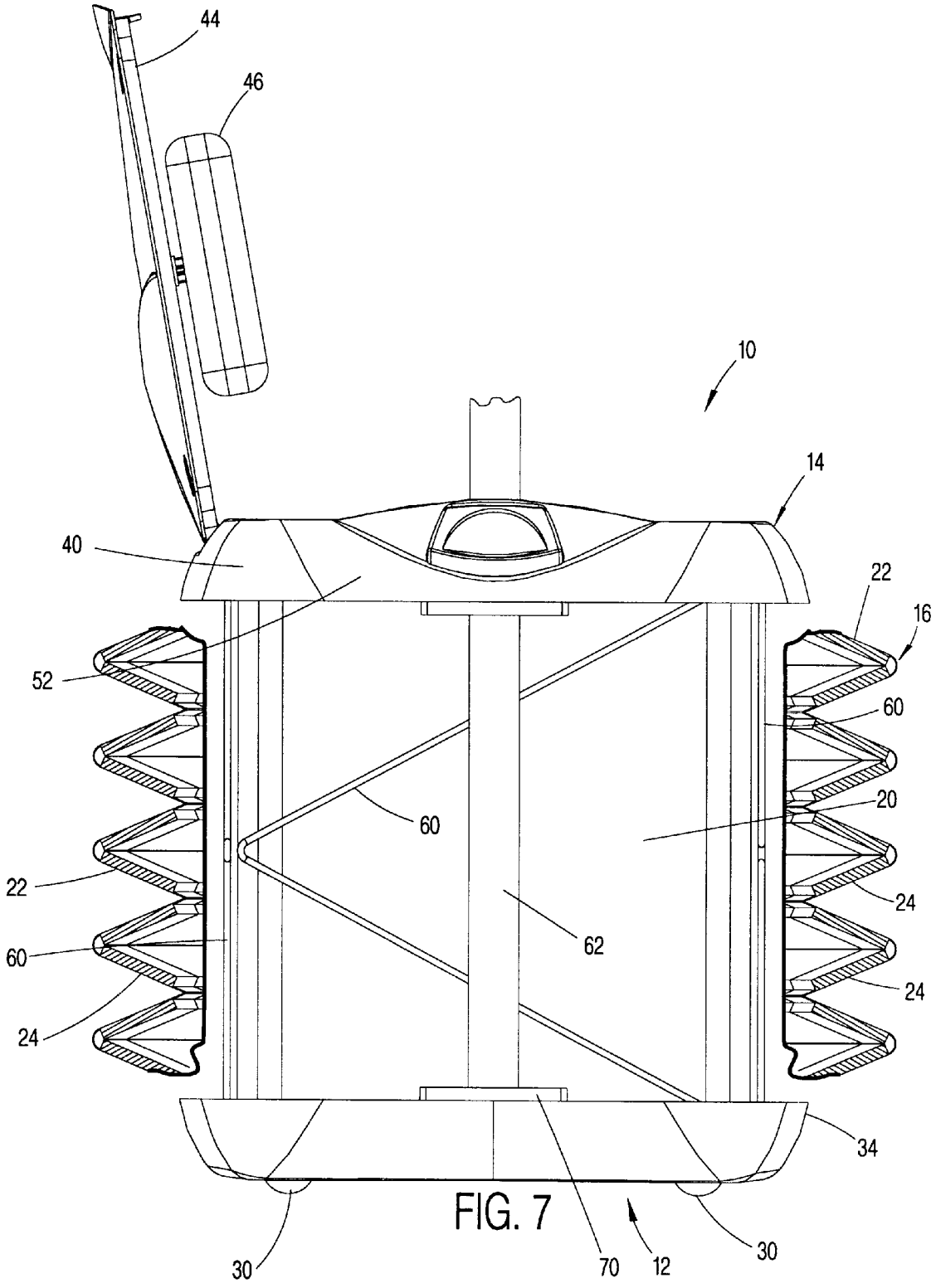
FIG. 7 is a side elevational view of the collapsible container with part of the exterior side wall removed and part depicted in section and fragmented.

Inner and outer circumferential lips, indicated generally by the numerals 50 and 52, respectively, extend downwardly from rim 40 to define a channel 54 therebetween. Interior wall 20 is connected to inner lip 50 while exterior wall 22 is connected to outer lip 52 such that interior wall 20 is spaced from exterior wall 22. As may be perhaps best seen in FIG. 5, outer lip 52 may have a slot 56 in its lower surface to receive the upper portion of exterior wall 22 to attach exterior wall 22 to outer lip 52. Exterior wall 22 may be held in slot 56 by a plurality of teeth 58 (FIG. 8) that engage wall 22 when it is pushed into slot 56.

It may now be understood that container 10 is collapsible and expandable in height. Container 10 may be collapsed by pushing first wall 12 and second wall 14 together to collapse third wall 16. When this occurs, pleats 24 of exterior wall 22 fold together as shown in FIG. 2 and interior wall 20 crumples. Similarly, container 10 may be expanded by pulling first wall 12 and second wall 14 to expand third wall 16. When this occurs, pleats 24 are pulled apart as shown in FIG. 1.

The present invention contemplates the use of a device to maintain the position of second wall 14 with respect to first wall 12 such that container 10 may be configured and maintained at any position between the fully expanded and fully collapsed positions. For example, pleats 24 of exterior wall 22 may be fabricated such that the friction in their pivot points is sufficient to maintain the configuration of container 10. Exterior or interior posts (not shown) may also be provided that may extend between first and second walls 12 and 14 to resist compression when container 10 is fully expanded. These posts may then be detached when container 10 is to be collapsed. It is also contemplated that when a telescoping exterior wall 22 is utilized, locking members may be provided that allow the telescoping wall to be locked at various positions. However, in the preferred embodiment of the present invention, at least one spring 60 is provided to urge first and second walls 12, 14 apart. A strap 62 and locking devices 64 are also provided to counteract the force of spring 60 such that container 10 may be configured to maintain any position between fully expanded and fully collapsed.

As shown, four springs 60 extend between first wall 12 and second wall 14 such that springs 60 are not fully expanded when container 10 is in the fully expanded position. Springs 60 are connected to first wall 12 by an appropriate anchor disposed in channel 36. Springs 60 are similarly connected to second wall 14 by an appropriate anchor disposed in channel 54. It can be understood that each spring 60 is disposed between interior wall 20 and exterior wall 22 of container 10 such that each spring 60 is hidden from view when container 10 is configured in any position between fully expanded and fully collapsed. It may also be seen in the drawings that opposed springs 60 are reversed such that spring 60 disposed at the front of container 10 and spring 60 disposed at the rear of container 10 point in opposite directions. Similarly, spring 60 disposed at the right side of container 10 and spring 60 disposed at the left side of container 10 point in opposite directions. This configuration of springs 60 allows container 10 to operate smoothly and evenly by preventing undesirable torques in container 10 and especially in third wall 16.

Figure 2:
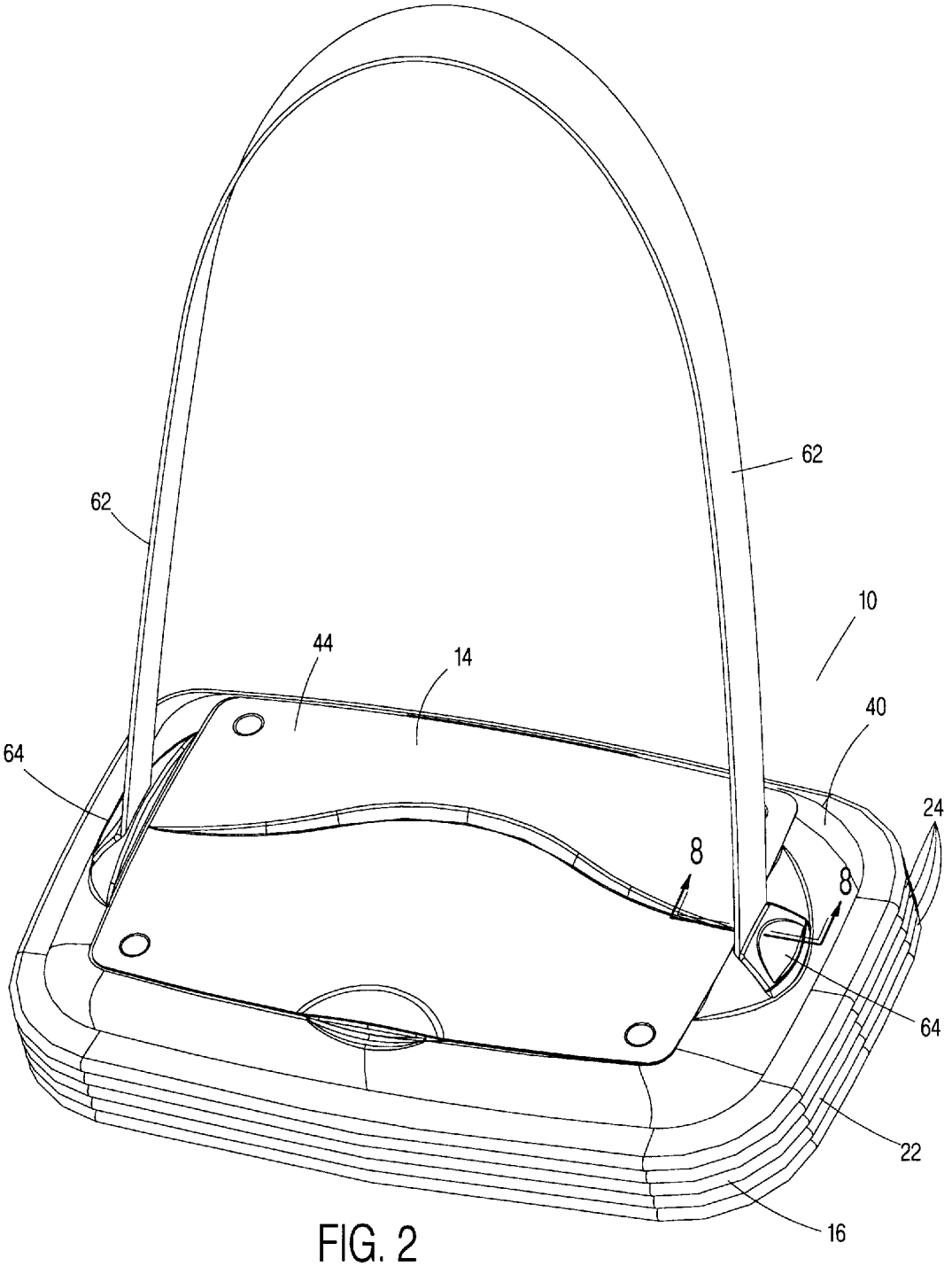
FIG. 2 is a perspective view of the collapsible container depicted in FIG. 1 shown in its fully collapsed position.

As may be seen in FIGS. 1 and 2, strap 62 extends from each side of container 10 and may be utilized as a carrying strap. Straps 62 are connected to first wall 12 by an appropriate anchor disposed in an anchoring box 70 that may be integrally formed in wall 12 disposed in channel 36. Straps 62 extend upwardly between interior wall 20 and exterior wall 22 adjacent springs 60. Straps 62 then pass through second wall 14 adjacent locking devices 64.

Figure 8:
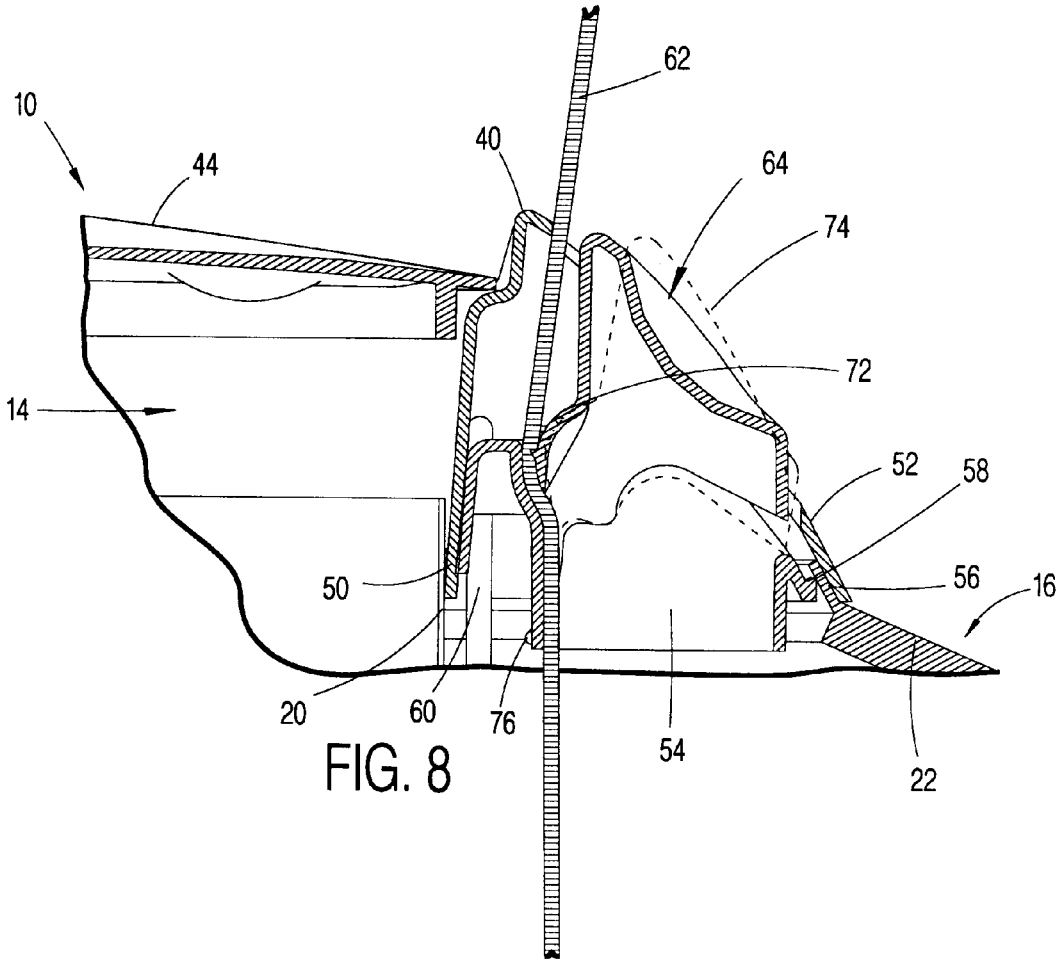
FIG. 8 is an enlarged, fragmented, sectional view taken substantially along line 8—8 of FIG. 2.

As shown in FIG. 8, each locking device 64 is a one-way locking device biased to engage strap 62 and hold the relative position of strap 62 with respect to second wall 14. A toothed area 72 is carried by locking device 64 such that toothed area 72 is urged into strap 62 to fix the length of strap 62 between locking device 64 and first wall 12. The length of strap 62 between locking device 64 and first wall 12 functions to counteract the force of springs 60 to maintain the configuration of container 10.

Locking devices 64 are configured to release strap 62 when locking device 64 is moved outwardly to an unlocked position which is labeled with the numeral 74 in FIG. 8. When locking device 64 is moved outwardly to the unlocked position, toothed area 72 disengages strap 62 to allow second wall 14 to slide along strap 62. In this condition, the configuration of container 10 may be adjusted and held at any selected position between fully expanded and fully collapsed. In the embodiment of locking devices 64 depicted in FIG. 8, toothed area 72 is biased toward strap 62 by cantilevered arms 76. In other embodiments of the present invention, locking devices 64 may include springs that urge toothed area 72 into strap 62.

Locking devices 64 are said to be one way because they are configured to allow straps 62 to slide upwardly through locking devices 64 without the requirement that displacing locking devices 64 be moved outwardly by a user. As such, when straps 62 are held by one hand and second wall 14 is pressed downwardly with another hand, locking devices 64 allow second wall 14 to slide downwardly along straps 62 to collapse container 10. As second wall 14 is moved downwardly, springs 60 are depressed to create force between first wall 12 and second wall 14. When the user releases second wall 14, locking devices 64 engage straps 62 to counteract the force of springs 60 to maintain the configuration of container 10 at the position where the user released wall 14. It should be understood that interior wall 20 and exterior wall 22 remain spaced from each other in all container 10 configurations. As such, the insulating air barrier is effective in all configurations.

To expand container 10, the user releases locking devices 64 by placing one hand on each device 64 and moving them outwardly to the unlocked positions. As locking devices 64 are moved outwardly, toothed areas 72 release straps 62 such that second wall 14 may slide freely along straps 62. In this position, the only force resisting the force of spring 60 is the force applied by the user. If the user desires to expand container 10, the user simply does not resist the forces of springs 60 and allows springs 60 to push second wall 14 away from first wall 12 to expand container 10. Container 10 automatically stops expanding when the upper limit of third wall 16 is reached. Third wall 16 is configured to reach its fully expanded position before springs 60 are fully expanded.

From the foregoing, it should be evident that the collapsible container described above achieves the objects of the present invention and otherwise improves the art.

We claim:

1. A collapsible container, comprising a substantially rigid base, an upper wall opposing said base, and a third wall joining said base and said upper wall; said upper wall and said base being movable toward and away from each other between fully expanded and fully collapsed positions; at least one spring carried by said base and said upper wall; and an additional spring oppositely disposed from said at least one spring such that said springs cooperate to reduce torques in said third wall.

2. A collapsible container according to claim 1 further comprising means for maintaining the relative position of said upper wall with respect to said base at any selected position between and including said fully expanded and fully collapsed positions.

3. A collapsible container according to claim 2 wherein said means for maintaining includes a strap extending between said base and said upper wall, said strap attached to said base and selectively attached to said upper wall such that said strap counteracts the force of said springs to maintain the position of said upper wall with respect to said base when said strap is attached to said upper wall.

4. A collapsible container according to claim 3 further comprising a locking device carried by said upper wall adjacent said strap, said locking device biased to normally engage said strap to attach said strap to said upper wall.

5. A collapsible container according to claim 1 wherein said third wall includes a collapsible and expandable interior wall and a collapsible and expandable exterior wall.

6. A collapsible container, according to claim 5 wherein said interior wall is spaced from said exterior wall by an insulating air barrier, said interior wall and said base defining an interior compartment that is at least partially insulated by said insulating air barrier.

7. A collapsible container according to claim 6 wherein the connection between said interior wall and said base is watertight.

8. A collapsible container according to claim 6 wherein said insulating air barrier is maintained at any selected position between and including said fully expanded and fully collapsed positions.

9. A collapsible container according to claim 1 further comprising a door pivotally carried by said upper wall between open and closed positions, said upper wall having an opening, said door substantially closing said opening when said door is in said closed position.

10. A collapsible container according to claim 9 further comprising a bottle carried by said door such that said bottle is inside the container when said door is in said closed position.

11. A collapsible container, comprising first and second walls; a third collapsible and expandable wall joining said first and second walls, at least one spring connected to said first and second walls urging said first and second walls apart; and at least one strap attached to said first wall and extending through said second wall to define a strap portion between said first and second walls, said strap being selectively attached to said second wall such that said portion of said strap between said first and second walls counteracts the force of said spring to maintain the position of said first wall with respect to said second wall.

12. A collapsible container according to claim 11 further comprising a locking device carried by said second wall adjacent said strap, said locking device biased to engage said strap and attach said strap to said second wall.

13. A collapsible container according to claim 12 wherein said locking device is a one-way device that permits said strap to be pulled upwardly through said locking device without manipulating said locking device.

14. A collapsible container according to claim 12 wherein said locking device may be manipulated to release said strap.

15. A collapsible container according to claim 11 further comprising means for counteracting the force of said spring to maintain the position of said first wall with respect to said second wall.

16. A collapsible container according to claim 15 wherein said collapsible and expandable third wall is collapsible and expandable between fully collapsed and fully expanded positions, said locking means capable of maintaining the relative position of said first wall with respect to said second wall at any position between said fully collapsed and said fully expanded positions.

17. A collapsible container comprising first and second walls; a third collapsible and expandable wall joining said first and second walls; at least one spring connected to said first and second walls urging said first and second walls apart; and an additional spring connected to said first and second walls urging said first and second walls apart, said additional spring oppositely disposed from said at least one spring such that said springs cooperate to reduce torques in said third wall.

18. A collapsible container, comprising first and second walls, a collapsible and expandable third wall extending between said first and second walls, at least one spring connected to said first and second walls urging said first and second walls apart, locking means for counteracting the force of said spring to maintain the relative positions of said first and second walls at a selected position, and a spring connected to said first and second walls at each side of said first and second walls, said locking means including straps extending between said first and second walls to counteract the force of said springs wherein said springs are oppositely disposed to reduce torque in said third wall.

19. A collapsible container according to claim 18 wherein said locking means includes at least one strap attached to said first wall and being selectably attached to said second wall such that said strap resists the force of said spring to maintain the position of said second wall with respect to said first wall when said strap is attached to said second wall.

20. A collapsible container according to claim 19 further comprising a locking device carried by said second wall, said locking device biased to normally engage said strap to attach said strap to said second wall.

* * * * *